US006055004A

United States Patent [19]

Fassler et al.

[11] Patent Number: 6,055,004

[45] **Date of Patent: *Apr. 25, 2000**

[54] MICROFLUIDIC PRINTING ARRAY VALVE

[75] Inventors: Werner Fassler, Rochester; James E. Pickering, Holcomb; Charles D. DeBoer, Palmyra, all of N.Y.

[73] Assignee: Eastman Kodak Company, Rochester, N.Y.

[ * ] Notice: This patent is subject to a terminal disclaimer.

[21] Appl. No.: 08/903,747

[22] Filed: Jul. 31, 1997

[51] Int. Cl.[7] ..... B41J 2/005

[52] U.S. Cl. ..... 346/140.1; 347/43

[58] Field of Search ..... 346/140.1; 347/43

[56] References Cited

U.S. PATENT DOCUMENTS

| | | | |
|---|---|---|---|
| 4,485,387 | 11/1984 | Drummheller | 346/140.1 |
| 4,675,694 | 6/1987 | BUpara | 346/140.1 |
| 5,585,069 | 12/1996 | Zanzucchi et al. . | |
| 5,593,838 | 1/1997 | Zanzucchi et al. . | |
| 5,603,351 | 2/1997 | Cherukuri et al. . | |
| 5,611,847 | 3/1997 | Guistina et al. . | |
| 5,745,128 | 4/1998 | Lam et al. | 346/140.1 |
| 5,771,810 | 6/1998 | Wolcott | 346/140.1 |
| 5,872,582 | 2/1999 | Pan | 347/65 |

*Primary Examiner*—N. Le
*Assistant Examiner*—Lamson D. Nguyen
*Attorney, Agent, or Firm*—Raymond L. Owens

[57] ABSTRACT

A microfluidic printing apparatus comprising at least one ink reservoir; a structure defining a plurality of chambers arranged so that the chambers form an array with each chamber being arranged to form an ink pixel; a plurality of microchannels connecting the reservoir to a chamber; and a plurality of microfluidic pumps each being associated with a single microchannel for supplying ink from an ink reservoir through a microchannel for delivery to a particular chamber. The apparatus provides relative movement between the microchannels and the structure so that the arrays can be effective in two positions; a blocking position for preventing the flow of ink from the microchannel to the chamber, and a printing position for aligning the chambers with the microchannels for permitting the flow of ink from microchannels into associated chambers to regulate the ink flow into the chambers. The apparatus further controls the microfluidic pumps and causes arrays to be in printing position when the microfluidic pumps supply ink through the microchannels to the chambers so that the correct amount of ink is delivered into each chamber.

2 Claims, 7 Drawing Sheets

MICROFLUIDIC PRINTING ARRAY VALVE

CROSS REFERENCE TO RELATED APPLICATIONS

The present invention is related to U.S. patent application Ser. No. 08/868,426 filed Jun. 3, 1997, entitled "Continuous Tone Microfluidic Printing" to DeBoer, Fassler, and Wen; U.S. patent application Ser. No. 08/868,416 filed Jun. 3, 1997 entitled "Microfluidic Printing on Receiver", to DeBoer, Fassler, and Wen; U.S. patent application Ser. No. 08/868,102, filed Jun. 3, 1997 entitled "Microfluidic Printing with Ink Volume Control" to Wen, DeBoer, and Fassler; U.S. patent application Ser. No. 08/868,477 filed Jun. 3, 1997 entitled "Microfluidic Printing with Ink Flow Regulation" to Wen, Fassler, and DeBoer, all assigned to the assignee of the present invention. The disclosure of these related applications is incorporated herein by reference.

FIELD OF THE INVENTION

The present invention relates to printing high quality images by microfluidic pumping of inks into receives such as paper.

BACKGROUND OF THE INVENTION

Microfluidic pumping and dispensing of liquid chemical reagents is the subject of three U.S. Pat. Nos. 5,585,069; 5,593,838; and 5,603,351, all assigned to the David Sarnoff Research Center, Inc. The system uses an array of micron sized reservoirs, with connecting microchannels and reaction cells etched into a substrate. Electrokinetic pumps comprising electrically activated electrodes within the capillary microchannels provide the propulsive forces to move the liquid reagents within the system. The electrokinetic pump, which is also known as an electroosmotic pump, has been disclosed by Dasgupta et al., see "Electroosmosis: A Reliable Fluid Propulsion System for Flow Injection Analysis", Anal. Chem. 66, pp 1792–1798 (1994). The chemical reagent solutions are pumped from a reservoir, mixed in controlled amounts, and them pumped into a bottom array of reaction cells. The array may be decoupled from the assembly and removed for incubation or analysis. When used as a printing device, the chemical reagent solutions are replaced by dispersions of cyan, magenta, and yellow pigment, and the array of reaction cells may be considered a viewable display of picture elements, or pixels, comprising mixtures of pigments having the hue of the pixel in the original scene. When contacted with paper, the capillary force of the paper fibers pulls the dye from the cells and holds it in the paper, thus producing a paper print, or photograph, of the original scene. One problem with this kind of printer is the accurate control of the print density. The problem comes about because the capillary force of the paper fibers is strong enough to remove all the ink from the device, draining it empty. If the paper is not removed from contact with the ink cells at the correct time, the print density will be too high or too low. Moreover, the correct paper contact time varies with the ambient temperature, making the timing problem more difficult. One solution to this problem is given in the above mentioned copending U.S. patent application Ser. No. 08/868,416, where a special paper is employed which will absorb only a limited amount of ink. Nevertheless, it would be cheaper if plain paper can be employed for this kind of printing. Another solution to this problem is given in the above mentioned copending U.S. patent application Ser. No. 08/868,477, wherein an array of microvalves, each individually addressed, controls the flow of ink to the paper. The complexity of individually addressed valves leads to a high cost printing apparatus. In would be cheaper and easier to manufacture a device that did not have to many individually addressed valves. A problem with microfluidic ink printers is that they can leak ink when not in the printing condition, and further that the ink can be contaminated by the outside environment causing degradation in properties.

SUMMARY OF THE INVENTION

It is an object of this invention is to provide a microfluidic printer which can rapidly print a high quality images on receiver such as plain paper without ink leakage or ink contamination by the environment.

Another object of this invention is to provide a compact, low power, portable printer.

These objects are achieved by a microfluidic printing apparatus comprising:

a) at least one ink reservoir;

b) a structure defining a plurality of chambers arranged so that the chambers form an array with each chamber being arranged to form an ink pixel;

c) a plurality of microchannels connecting the reservoir to a chamber;

d) a plurality of microfluidic pumps each being associated with a single microchannel for supplying ink from an ink reservoir through a microchannel for delivery to a particular chamber;

e) means for providing relative movement between the microchannels and the structure so that the arrays can be effective in two positions; a blocking position for preventing the flow of ink from the microchannel to the chamber, and a printing position for aligning the chambers with the microchannels for permitting the flow of ink from microchannels into associated chambers to regulate the ink flow into the chambers; and e) control means for controlling the microfluidic pumps and the relative movement means for causing arrays to be in printing position when the microfluidic pumps supply ink through the microchannels to the chambers so that the correct amount of ink is delivered into each chamber.

ADVANTAGES

A feature of the present invention is that it provides apparatus which produces high quality prints of the correct density on plain paper.

A further feature of the invention is that apparatus, in accordance with the present invention, prevents the outside environment from acting on inks to degrade their properties.

Another feature of the invention is that the printer is low power, compact, and portable.

Another feature of the invention is that the printing process is fast, because all the pixels are printing simultaneously.

Another feature of the invention is that the printer is of low cost to manufacture, because a single actuator serves to actuate all the pixel valves simultaneously.

DETAILED DESCRIPTION OF THE INVENTION

The present invention is described in relation to a microfluidic printing apparatus which can print computer generated images, graphic images, line art, text images and the like, as well as continuous tone images.

Figure 1:
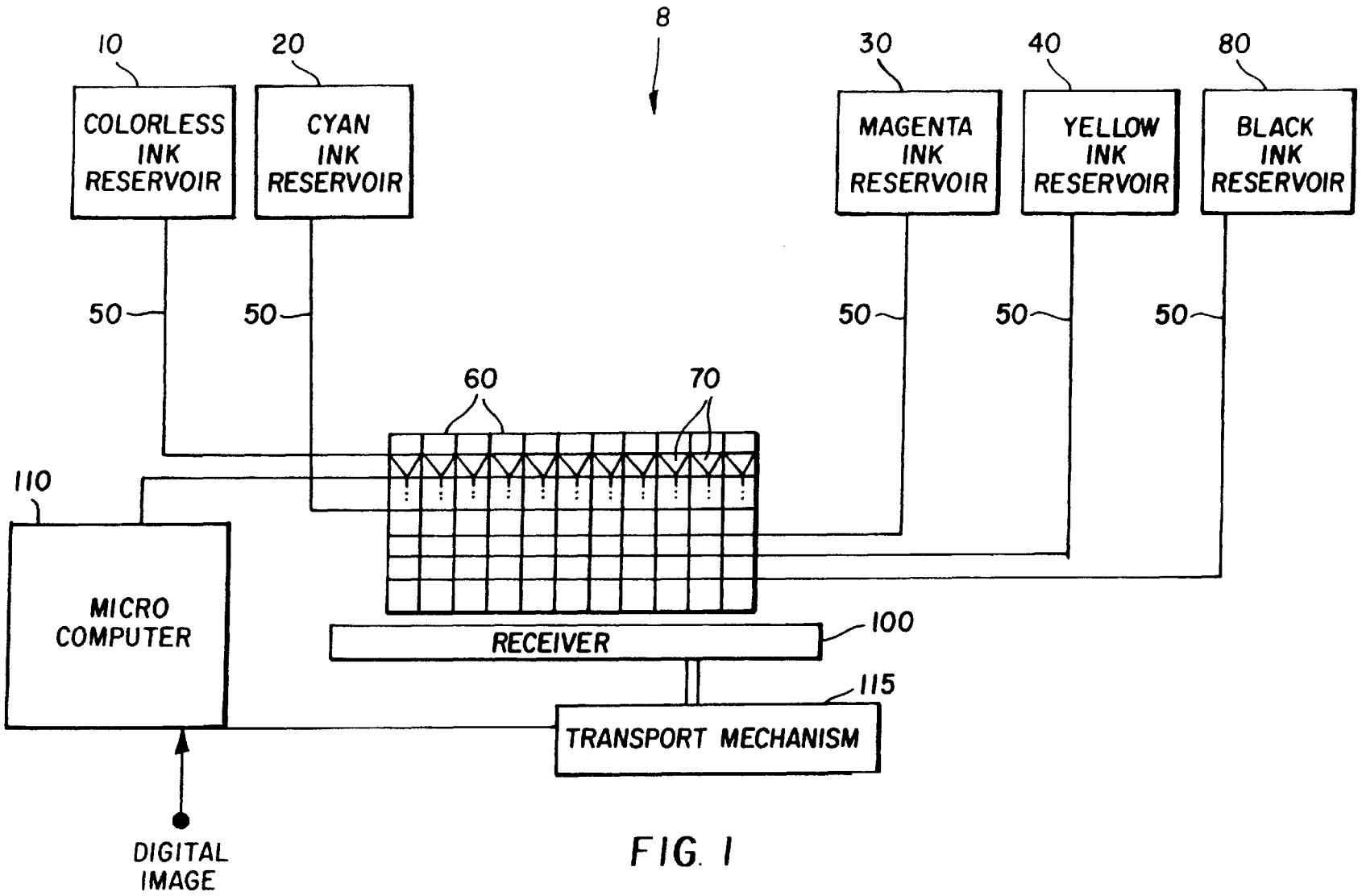
FIG. 1 is a partial schematic showing a microfluidic printing system for printing a digital image on a reflective receiver.

Referring to FIG. 1, a schematic diagram is shown of a printing apparatus 8 in accordance with the present invention. Reservoirs 10, 20, 30, and 40 are respectively provided for holding colorless ink, cyan ink, magenta ink, and yellow ink. An optional reservoir 80 is shown for black ink. Microchannel capillaries 50 respectively connected to each of the reservoirs conduct ink from the corresponding reservoir to an array of ink chambers 60. In the present invention, the ink chambers 60 delivery the inks directly to a receiver; however, other types of ink delivery arrangements can be used such as microfluidic channels, and so when the word chamber is used, it will be understood to include those arrangements. The colored inks are delivered to ink chambers 60 by electrokinetic pumps 70. The amount of each color ink is controlled by microcomputer 110 according to the input digital image. For clarity of illustration, only one set of electrokinetic pumps is shown for the colorless ink channel. Similar pumps are used for the other color channels, but these are omitted from the FIG. for clarity. Finally, a reflective receiver 100 is transported by a transport mechanism 115 to come in contact with the microfluidic printing apparatus. The receiver 100 receives the ink and thereby produces the print. Receivers may include common bond paper, made from wood fibers, as well as synthetic papers made from polymeric fibers. In addition receiver can be of non-fibrous construction, provided they absorb and hold the ink used in the printer.

Figure 2:
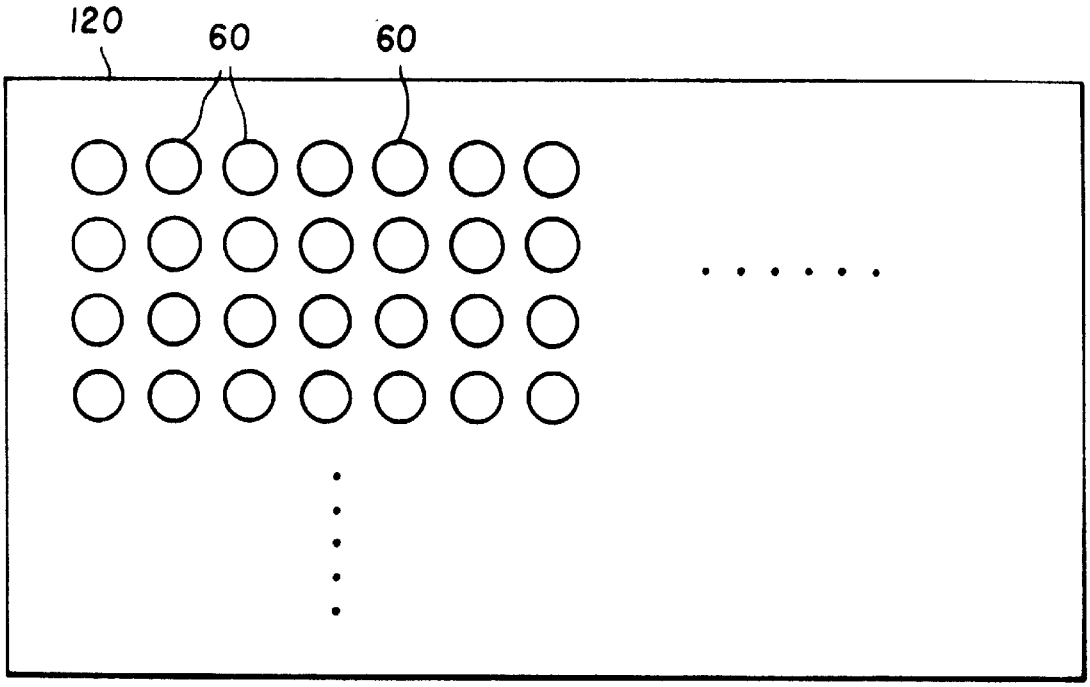
FIG. 2 is a top view of a pattern of the color pixels which can be produced by apparatus in accordance with the present invention.

FIG. 2 depicts a top view of an arrangement of chambers 60 shown in FIG. 1. Each ink chamber 60 is capable of producing a mixed ink having any color saturation, hue and lightness within the color gamut provided by the set of cyan, magenta, yellow, and colorless inks used in the apparatus.

The inks used in this invention are dispersions of colorants in common solvents. Examples of such inks may be found is U.S. Pat. No. 5,611,847 by Gustina, Santilli, and Bugner. Inks may also be found in the following commonly assigned U.S. patent application Ser. No. 08/699,955 filed Aug. 20, 1996; U.S. patent application Ser. No. 08/699,962 filed Aug. 20, 1996; and U.S. patent application Ser. No. 08/699,963 filed Aug. 20, 1996 by McInerney, Oldfield, Bugner, Bermel, and Santilli; and in U.S. patent application Ser. No. 08/790,131 filed Jan. 29, 1997 by Bishop, Simons, and Brick; and in U.S. patent application Ser. No. 08/764,379 filed Dec. 13, 1996 by Martin. In a preferred embodiment of the invention the solvent is water. Colorants such as the Ciba Geigy Unisperse Rubine 4BA-PA, Unisperse Yellow RT-PA, and Unisperse Blue GT-PA are also preferred embodiments of the invention. The colorless ink of this invention is the solvent for the colored inks in the most preferred embodiment of the invention.

The microchannel capillaries, ink pixel chambers 60 and microfluidic pumps are more fully described in the references listed above.

Figure 3:
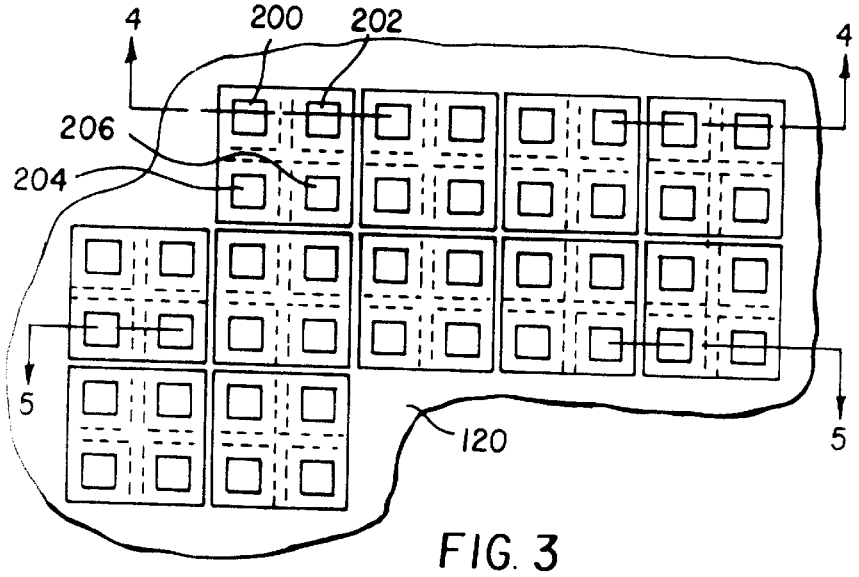
FIG. 3 is a top view of a second pattern of the color pixels which can be produced by apparatus in accordance with the present invention.

FIG. 3 illustrates the arrangement of a second pattern of color pixels in the present invention. The ink chambers 60 are divided into four groups cyan ink orifice 200; magenta ink orifice 202; yellow ink orifice 204; and black ink orifice 206. Each chamber 60 is connected only to the respective colored ink reservoir and to the colorless ink reservoir 10. For example, the cyan ink orifice 200 is connected to the cyan ink reservoir and the colorless ink reservoir so that cyan inks can be mixed to any desired lightness. When the inks are transferred to the reflective receiver 100 some of the inks can mix and blend on the receiver. Inasmuch as the inks are in distinct areas on the receiver, the size of the printed pixels should be selected to be small enough so that the human eye will integrate the color and the appearance of the image will be that of a continuous tone photographic quality image.

Figure 4:
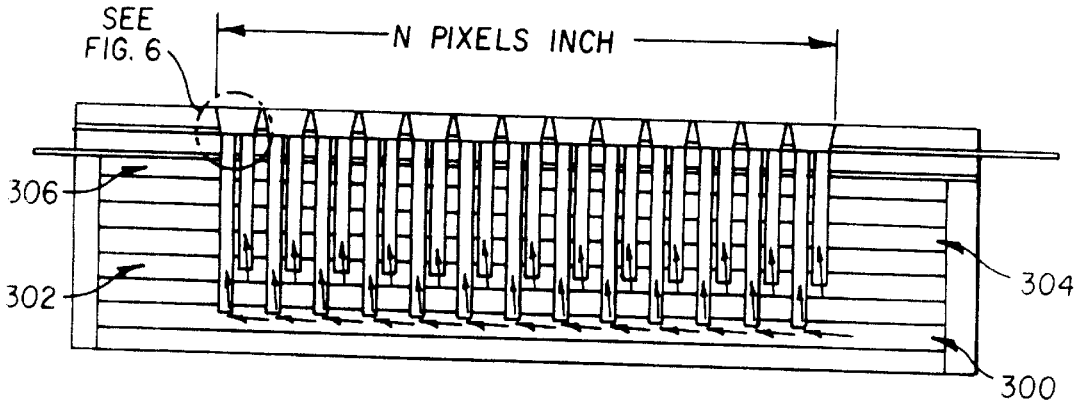
FIG. 4 is a cross-sectional view taken along the lines 4—4 of the microfluidic printing apparatus in FIG. 3.
Figure 5:
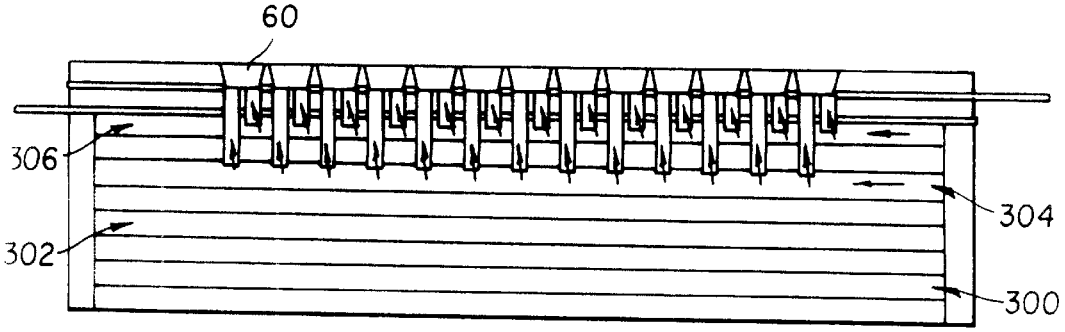
FIG. 5 is another cross-sectional taken along the lines 5—5 of the microfluidic printing apparatus in FIG. 3.

Cross-sections of the color pixel arrangement shown in FIG. 3 are illustrated in FIG. 4 and FIG. 5. The colored ink supplies 300, 302, 304, and 306 are fabricated in channels parallel to the printer front plate 120. The cyan, magenta, yellow and black inks are respectively delivered by colored ink supplies 300, 302, 304, and 306 into each of the colored ink chambers 60.

Figure 6:
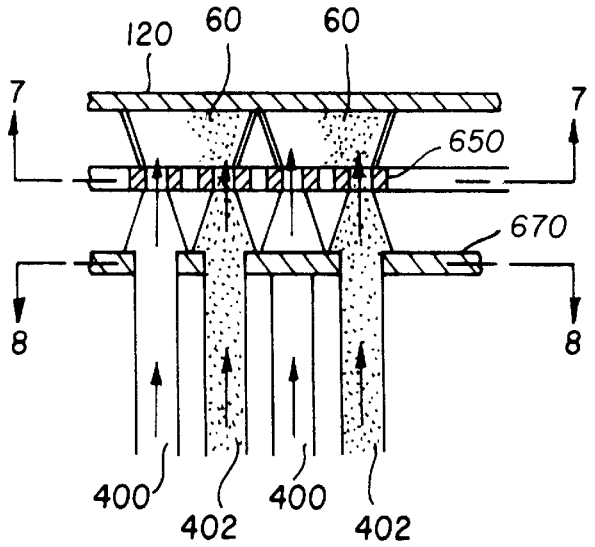
FIG. 6 is an enlarged view of the circled portion of FIG. 4.
Figure 8:
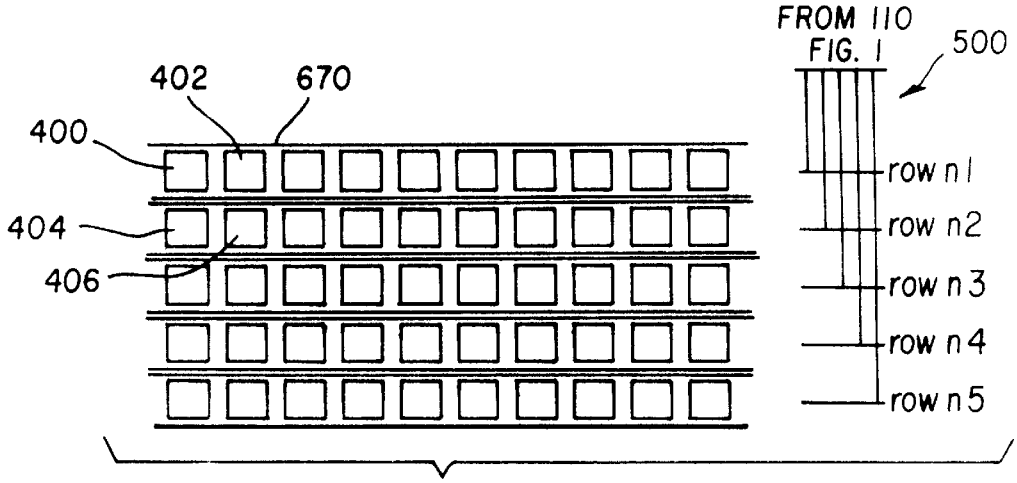
FIG. 8 is a top view of the microchannel and showing conducting circuit connections in FIG. 6.

A detailed view of the cross-section in FIG. 4 is illustrated in FIG. 6. The colored inks are delivered to the ink chambers 60 respectively by cyan, magenta, yellow, and black ink microchannels 400, 402, 404, and 406 (404 and 406 do not show up in the plan shown in FIG. 6, but is illustrated in FIG. 8) The colored ink microchannels 400, 402, 404, and 406 are respectively connected to the colored ink supplies 300, 302, 304, and 306 (FIGS. 4 and 5). The colorless ink is supplied to the ink chamber 60, but is not shown in FIG. 6 for clarity of illustration.

Figure 7:
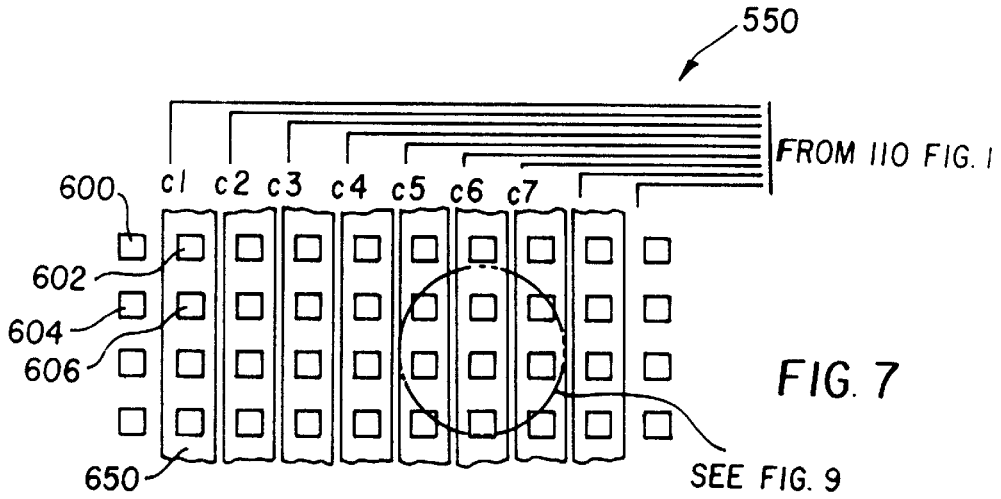
FIG. 7 is a top view of the micronozzles shown in FIG. 6.

A cross-section view of the plane containing the micronozzles in FIG. 6 is shown in FIG. 7. The cyan, magenta, yellow, and black ink micronozzles 600, 602, 604, and 606 are distributed in the same arrangement as the colored ink supply lines 300–304 and the termination of the chambers 60 which are colored ink orifices 200–206. The column electrodes 650 are shown connected to the conducting circuit 550, which is further connected to microcomputer 110.

A cross-section view of the plane containing the microchannels 400, 402, 404, and 406 in FIG. 6 is shown in FIG. 8. The color ink channels 400–406 are laid out in the spatial arrangement that corresponds to those in FIGS. 3 and 7. The lower electrodes in the electrokinetic pumps for delivering the colored inks are not shown for clarity of illustration. The row electrodes 670 are connected to lower electrodes of the electrokinetic pumps. The row electrodes 670 are shown connected to the conducting circuit 500, which is further connected to microcomputer 110.

The operation of a microfluidic printer comprises the steps of activating the electrokinetic pumps to pump the correct amount of each color ink to the chamber 60 to provide a pixel of the correct hue and intensity corresponding to the pixel of the scene being printed. The receiver is then contacted to the chambers 60 and capillary or absorption forces draw the ink from the chambers 60 to the receiver. The receiver is then removed from contact with the chambers 60 and permitted to dry. Timing of the removal of the receiver is critical to prevent excess ink to be drawn from the microchannels 400, 402, 404, and 406 that feed the chambers 60.

Figure 9:
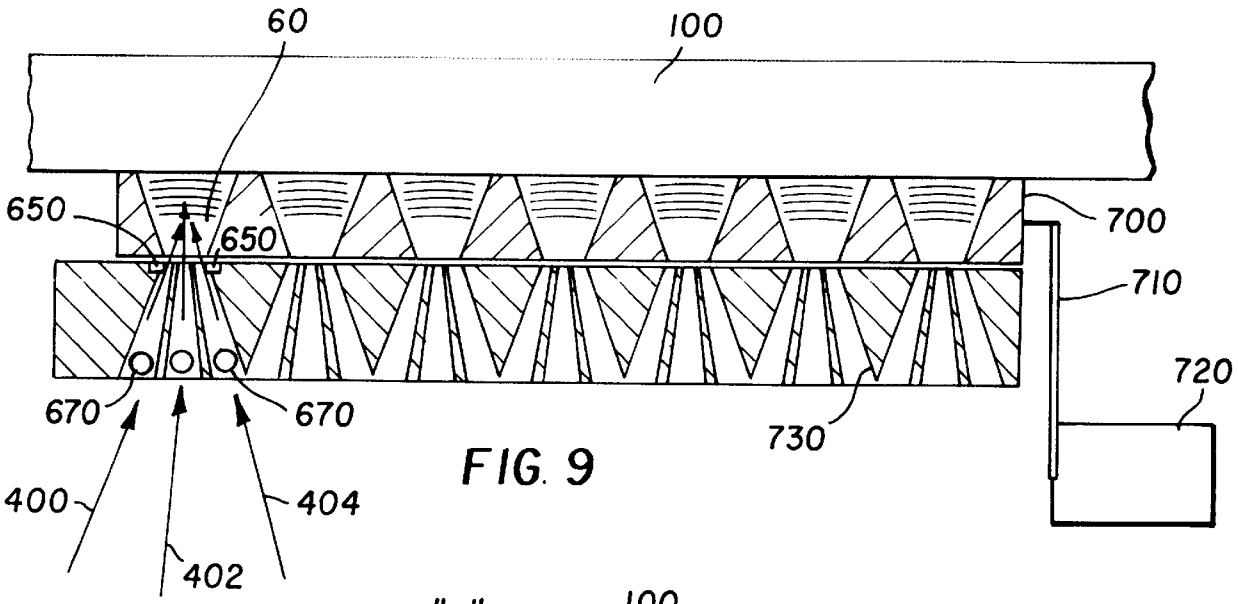
FIG. 9 is a cross-sectional view of the moveable shutter plate in the "on" position.

FIG. 9 illustrates an embodiment of the present invention. A moveable shutter plate 700 having a single orifice 740 for each pixel area is disposed contiguously over an ink supply plate 730. The moveable shutter plate 700, controlled by an actuator 720 and a mechanical linkage 710, having ink chambers 60, which provide an ink delivery function to receivers such as paper. Accordingly, these chambers 60 also provide a nozzle function and will sometimes be referred to as nozzles. The chambers 60 or nozzles are adapted to be moveable into communication with microfluidic ink channels 400, 402 and 404. The ink channels contain bottom or row electrodes 670 which, along with the top or column electrodes 650, make an electrical circuit which receives electrical signals produced at the proper time by the microcomputer 110. The amount and duration of the current in this circuit generates the pumping force of the electrokinetic pump which causes the ink to flow into chambers 60 when they are in a printing position, as will be described. The moveable shutter plate 700 defines the plurality of chambers 60. The chambers 60 are arranged so that they form an array with each chamber 60 being arranged to form an ink pixel of mixed colored ink. The plates are moveable between blocking and printing positions wherein the blocking position prevents the flow of ink from the microchannel to the chamber 60 and the printing position aligns the chambers 60 with the microchannels 400, 402, 404, and 406 for permitting the flow of ink from microchannels 400, 402, 404, and 406 into associated chambers 60 to regulate the ink flow into the chambers 60. An important feature of the invention is to provide relative movement between the microchannels 400, 402, 404, and 406 and the structure that forms the chambers 60 so that the arrays can be effective in two positions; a blocking position for preventing the flow of ink from the microchannel to the chamber 60, and a printing position for aligning the chambers 60 with the microchannels 400, 402, 404, and 406 for permitting the flow of ink from microchannels 400, 402, 404, and 406 into associated chambers 60 to regulate the ink flow into the chambers 60. It will be understood that moveable shutter plate 700, when in a blocking position may completely prevent communication between the microchannels 400, 402, 404, and 406. However, it can still provide blocking even though there is some communication between the microchannel and their corresponding chambers 60 if such communication is insufficient to deliver ink to the chambers 60 because of the capillary forces acting on the ink in the microchannels 400, 402, 404, and 406. When the correct amount of all colored inks, here illustrated as, but not limited to, three inks, is pumped into a chamber 60, the ink is mixed and corresponds to the color and intensity of a desired image pixel, the moveable shutter plate 700 is moveable by an actuator 720 via the mechanical linkage 710 through the distance "y" in FIG. 10 to the "off" or blocking position shown in FIG. 10, thus blocking further movement of ink into the chambers 60. The receiver 100 can then be brought into contact with the moveable shutter plate 700 so the ink can be absorbed by the receiver to furnish the printed image.

Figure 10:
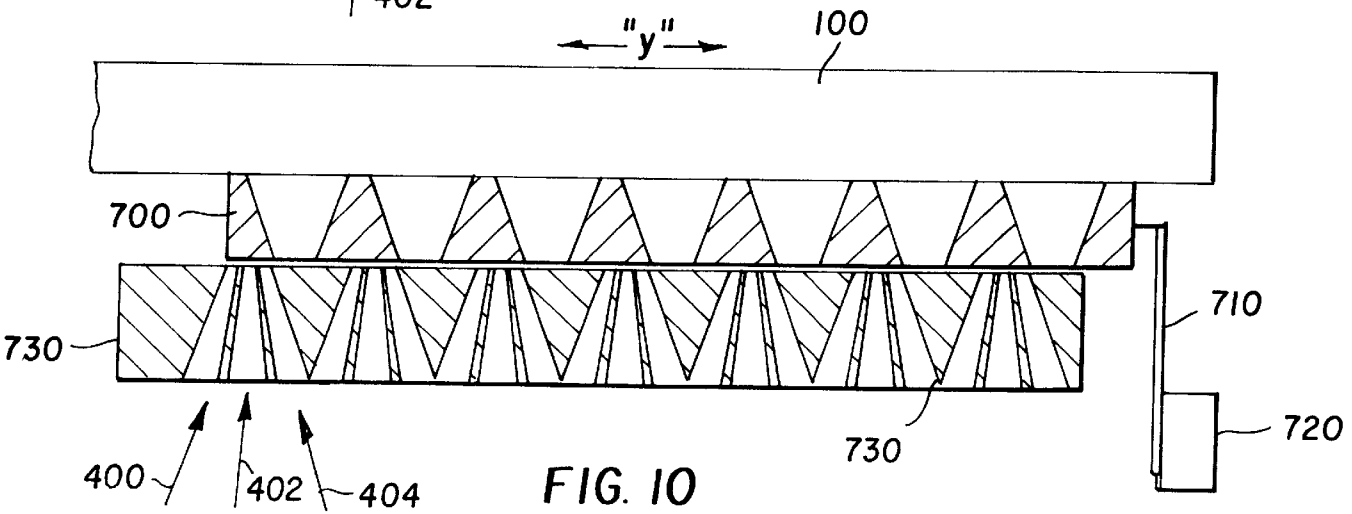
FIG. 10 is a cross sectional view of the moveable shutter plate in the "off" position.
Figure 11:
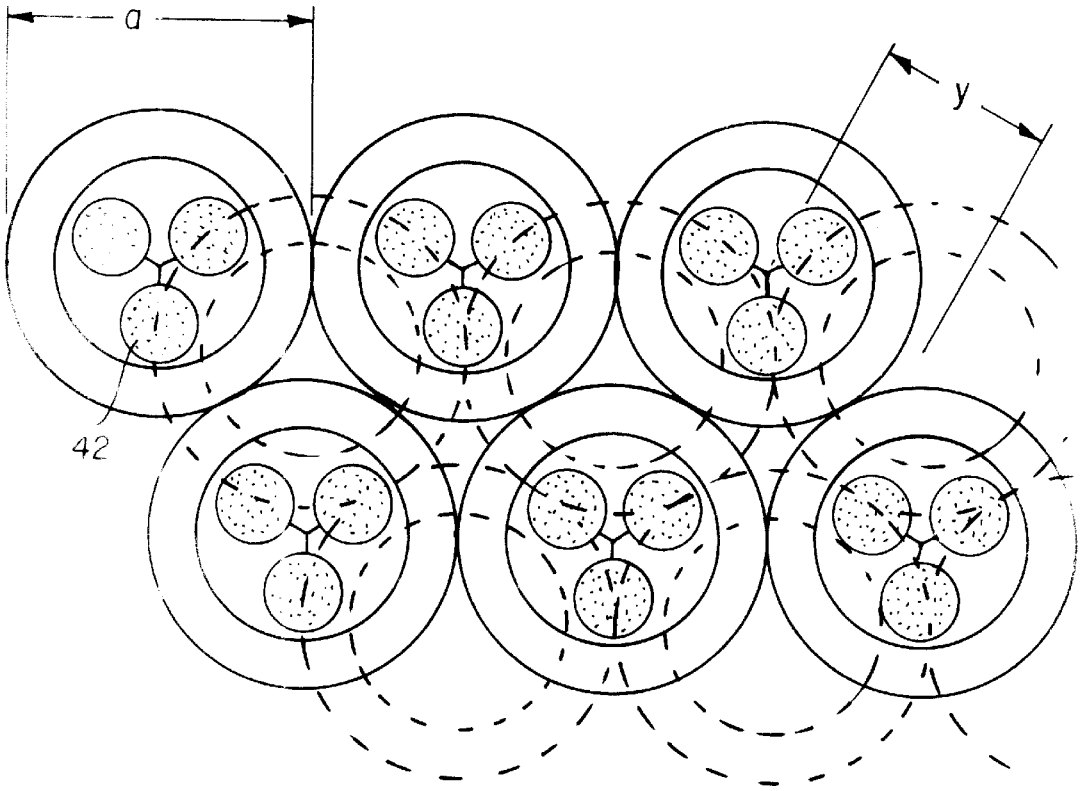
FIG. 11 is a top view of the moveable shutter plate showing the printing sequence where each line and pixel is printed by a separate nozzle.
Figure 12:
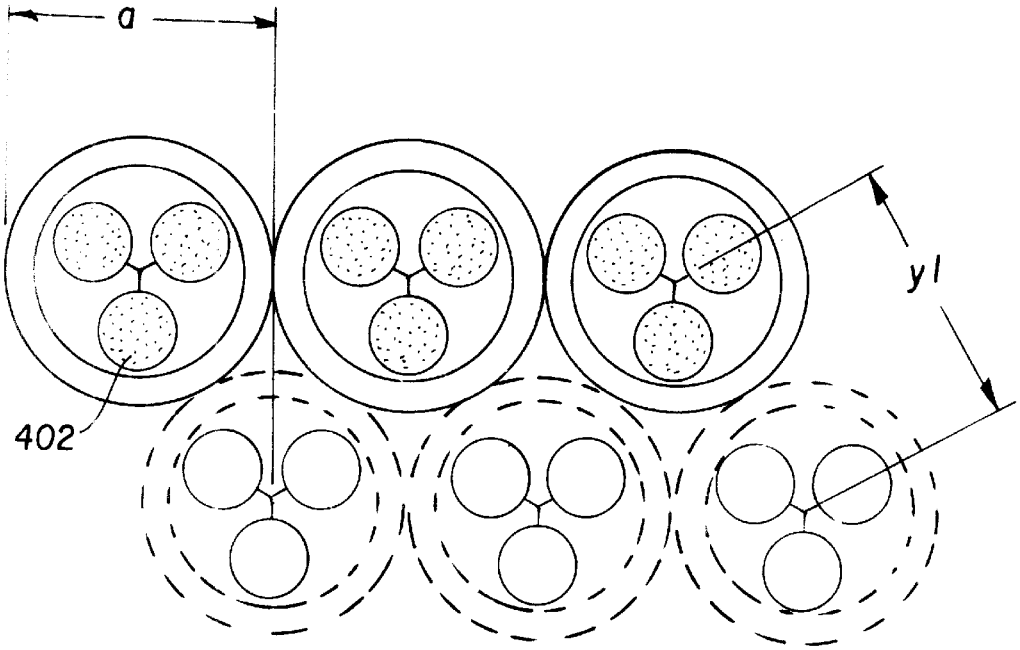
FIG. 12 is a top view of the moveable shutter plate showing a nozzle geometry wherein the "off" position is a new pixel position.
Figure 13:
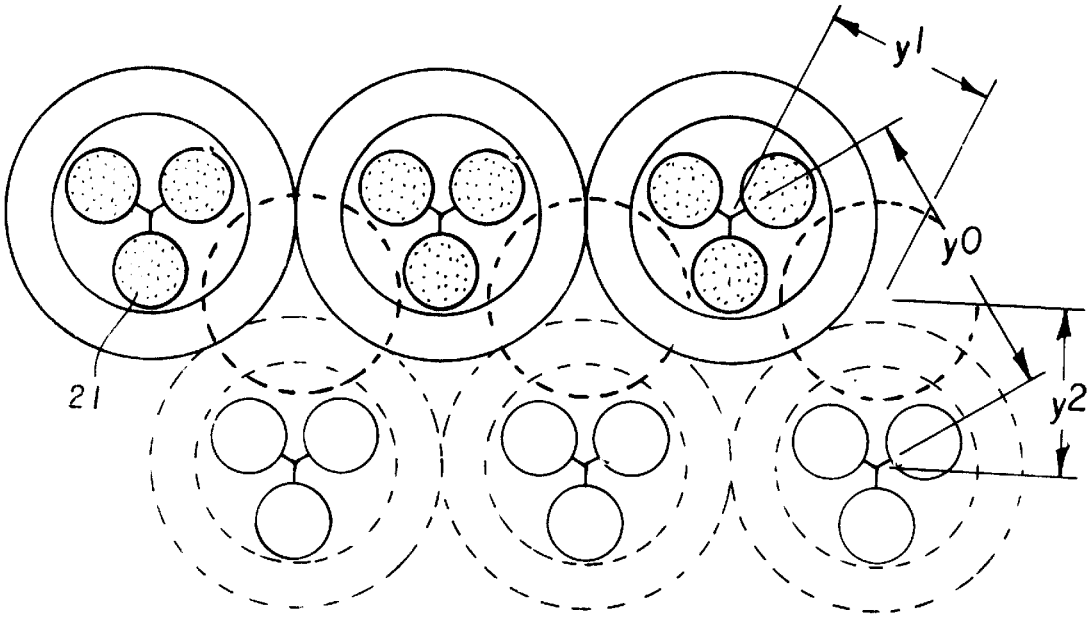
FIG. 13 is a top view of the moveable shutter plate of FIG. 11, showing a printing sequence wherein one line of nozzles is used to print two lines of pixels.
Figure 14:
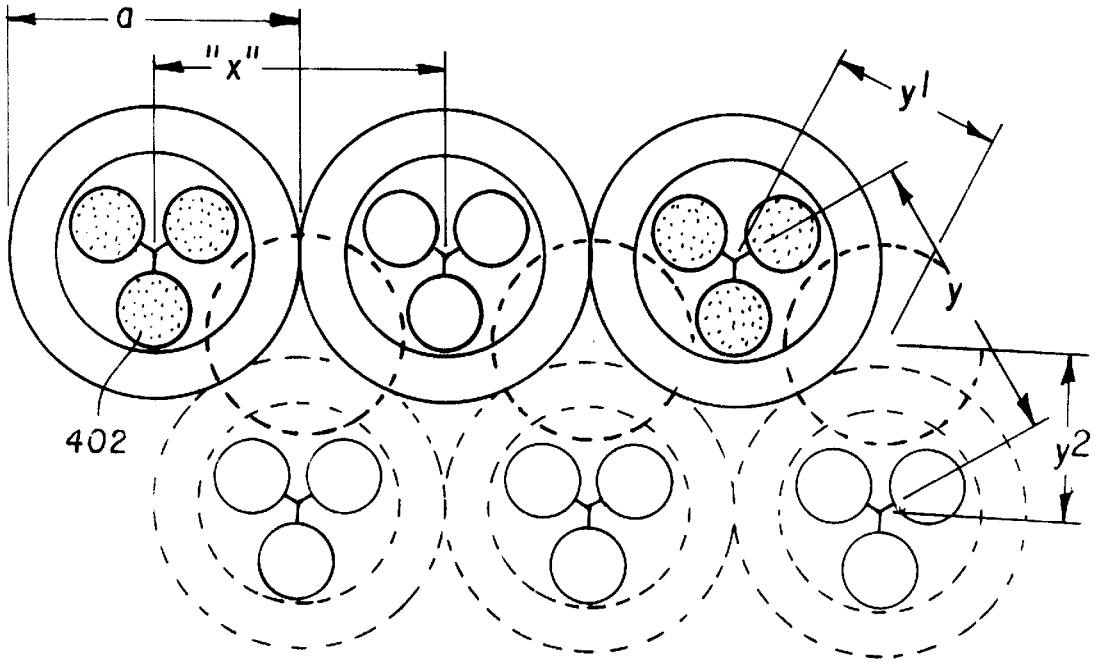
FIG. 14 is a top view of the moveable shutter plate showing a printing sequence where a single nozzle is used to print two pixels in a given line as well as a pixel in the next adjacent line.

FIG. 11 shows a top view of the shutter plate of FIGS. 9 and 10. The larger solid circles of diameter "a" represent the top of the opening of the chamber or nozzle 60. The smaller circle inside the diameter "a" represents the bottom of the chamber or nozzle 60. The three black circles 400, 402 and 404 are the microchannel openings which conduct the inks to the chamber 60. Movement of the moveable shutter plate 700 along the direction and distance of the vector "y" moves the chambers 60 to the positions shown by the dotted line circles, which is the "off" position where no ink can flow from the microchannels 400, 402, 404, and 406 to the chambers 60. In the printing scheme embodied in FIG. 11, there is a chamber, or nozzle 60, for each pixel in the final printed image. FIG. 12 shows a slightly different geometry for the shutter plate, and a different printing scheme. In FIG. 12 the top of the opening of the chamber 60 is slightly smaller than that of FIG. 11, so that the chambers 60, or printing nozzles, may be more closely spaced for a higher resolution image. In this case there is not enough space between the chambers 60 to completely shut off the ink flow from all of the microchannels 400, 402, 404, and 406. The moveable shutter plate is therefore moved in the direction and distance of the vector "Y1" to the position of the adjacent line of pixels, thus shutting off the flow of ink to the first line of pixels. In this printing scheme the receiver is brought into contact to the shutter plate to print the odd numbered lines of pixels, then separated from the shutter plate, and then the even lines of ink chambers 60 are filled with ink, after which the shutter plate returns to the starting position, thus shutting off the flow of ink to the even numbered lines of ink chambers 60 and the receiver is again brought into contact with the shutter plate to print the even numbered lines of the image. FIG. 13 shows yet another embodiment of this invention, wherein the shutter plate moves from the "off" position indicated by the dashed circles in the direction and distance indicated by the vector "y1" to print the first line of pixels, then back to the "off" position, and then in the direction and distance indicated by the vector "y2" to print a second line of pixels. The distance "y" is a measure of the resolution, or pitch of the pixels of the image. FIG. 14 shows yet another embodiment of the invention, in which as shutter plate with only half as many chambers 60, or nozzles, is used. The printing sequence begins at the "off" position indicated by the dashed circles. The shutter moves the direction and distance indicated by the vector "y1" to print the first set of pixels, and then back to the "off" position. The shutter then moves the direction and distance indicated by the vector "y2" to print the second set of pixels, and then back to the "off" position. The shutter then moves the direction and distance indicated by the vector "y3" to print the third set of pixels, and then back to the off position. The advantage of this embodiment is that each set of pixels, which are well separated in distance, may be permitted to dry before the next set is printed, which may prevent bleeding and mixing of the wet inks with certain kinds of receivers.

The invention has been described in detail with particular reference to certain preferred embodiments thereof, but it will be understood that variations and modifications can be effected within the spirit and scope of the invention.

| PARTS LIST | |
|---|---|
| 8 | microfluidic printing system |
| 10 | colorless ink reservoir |
| 20 | cyan ink reservoir |
| 30 | magenta ink reservoir |
| 40 | yellow ink reservoir |
| 50 | microchannel capillaries |
| 60 | ink chambers or printing nozzles |
| 70 | electrokinetic pumps |
| 80 | black ink reservoir |
| 100 | receiver |
| 110 | microcomputer |
| 115 | transport mechanism |
| 120 | printer front plate |
| 200 | colored ink orifices |
| 202 | colored ink orifices |
| 204 | colored ink orifices |
| 206 | colored ink orifices |
| 300 | colored ink supply lines |
| 302 | colored ink supply lines |
| 304 | colored ink supply lines |
| 306 | black ink supply |
| 400 | cyan ink microchannel |
| 402 | magenta ink microchannel |
| 404 | yellow ink microchannel |
| 406 | black ink microchannel |
| 500 | conducting circuit |
| 550 | conducting circuit |
| 600 | cyan ink micro-orifice |
| 602 | magenta ink micro-orifice |
| 604 | yellow ink micro-orifice |
| 606 | black ink micro-orifice |
| 650 | column electrodes |
| 670 | row electrodes |
| 700 | moveable shutter plate |
| 710 | mechanical linkage |
| 720 | actuator |
| 730 | ink supply plate |

What is claimed is:

1. A microfluidic printing apparatus comprising:

a) at least one ink reservoir;

b) a moveable shutter plate defining a plurality of chambers arranged so that the chambers form an array with each chamber being arranged to form an ink pixel;

c) a plurality of microchannels each microchannel connecting the reservoir to each chamber;

d) a plurality of microfluidic pumps each being associated with each microchannel for supplying ink from the ink reservoir through each microchannel for delivery to a particular chamber said plurality of chambers;

e) means coupled to the moveable shutter plate and effective for moving the plate between blocking and printing positions wherein the blocking position prevents the flow of ink from the microchannels to the chambers and the printing position aligns the chambers with the microchannels for permitting the flow of ink from the microchannels into the associated chambers to regulate the ink flow into the chambers; and f) control means for controlling the microfluidic pumps and the movement of the moveable shutter plate for causing the arrays to be in the printing position when the microfluidic pumps supply the ink through the microchannels to the chambers so that the correct amount of ink is delivered into each chamber and into the blocking position when the ink delivery to the chambers is not desired.

2. A microfluidic printing apparatus comprising:

a) a plurality of ink reservoirs each containing a different color ink;

b) a moveable shutter plate defining a plurality of chambers arranged so that the chambers form an array with each chamber being arranged to form an ink pixel;

c) a plurality of microchannels each microchannel connecting each of the reservoirs to each of the chambers;

d) a plurality of microfluidic pumps each being associated with each microchannel for supplying a particular colored ink from an ink reservoir through each microchannel for delivery to a particular chamber such that colored inks are mixed in each chamber to provide predetermined colored ink for printing the pixel;

e) means coupled to the moveable shutter plate and effective for moving the plate between blocking and printing positions wherein the blocking position prevents the flow of ink from the microchannels to the chambers and the printing position aligns the chambers with the microchannels for permitting the flow of colored ink from the microchannels into the associated chambers for mixing in such chambers and for regulating the ink flow into the chambers; and e) control means for controlling the microfluidic pumps and the movement of the moveable shutter plate for causing the arrays to be in the printing position when the microfluidic pumps supply the colored inks through the microchannels to the chambers so that the correct amount of colored inks is delivered for mixing into each chamber and into the blocking position when the ink delivery to the chambers is not desired.

* * * * *